United States Patent [19]

Tatro

[11] Patent Number: 4,967,768

[45] Date of Patent: Nov. 6, 1990

[54] MALE SHORTS HAVING PROTECTIVE CUP SUPPORTER

[76] Inventor: Le Ann M. Tatro, 416 Fairlane Dr., Joliet, Ill. 60435

[21] Appl. No.: 391,828

[22] Filed: Aug. 10, 1989

Related U.S. Application Data

[63] Continuation of Ser. No. 201,805, Jun. 3, 1988, abandoned.

[51] Int. Cl.[5] ..... A61F 5/40

[52] U.S. Cl. ..... 128/891

[58] Field of Search ..... 2/2; 128/78, 98.1, 158, 128/159, 160, 846, 891, 894

[56] References Cited

U.S. PATENT DOCUMENTS

| | | | |
|---|---|---|---|
| 1,972,275 | 9/1934 | Record | 128/158 |
| 3,229,692 | 1/1966 | Creed | 128/158 |
| 3,545,446 | 12/1970 | Nobbs | 128/78 |
| 3,782,375 | 1/1974 | Donars | 128/158 |
| 3,788,314 | 1/1974 | Noreen | 128/159 |
| 3,807,394 | 4/1974 | Attenborough | 606/60 |
| 3,844,282 | 10/1974 | King | 128/159 |
| 3,862,631 | 1/1975 | Austin | 606/60 |
| 3,939,828 | 2/1976 | Mohr et al. | 606/72 |
| 3,960,147 | 6/1976 | Murray | 606/75 |
| 4,026,520 | 5/1977 | Rothfuss et al. | 254/28 |
| 4,134,400 | 1/1979 | DiMatteo | 128/158 |
| 4,377,008 | 3/1983 | Jung | 128/159 |
| 4,434,796 | 3/1984 | Karapetian et al. | 606/75 |
| 4,453,541 | 6/1984 | Castelli et al. | 128/158 |
| 4,471,772 | 9/1984 | Miller, Jr. | 128/159 |
| 4,540,110 | 9/1985 | Bent et al. | 227/8 |
| 4,660,554 | 4/1987 | Wright | 128/158 |

FOREIGN PATENT DOCUMENTS 64726 8/1982 Israel .

OTHER PUBLICATIONS

Bogush et al., *Instrument for Mechanical Stitching of Bone,* Central Scientific-Research Institute of Tuberculosis, Central Scientific Research Institute of Stomatology, All-Union Scientific Research and Test Institute of Medical Equipment, Moscow, Translated from Meditsinskaya Tekhnika, No. 4, pp. 52-54, Jul.-Aug., 1974, Original article submitted Jan. 1, 1973, Attached pp. 245-247.

Cranin et al., *The Infraorbital Rim Staple—A New Method of Treating Displaced and Comminuted Trimalar Fractures,* 37, J. Oral Surgery, 364, 365 (May 1979).

*Primary Examiner*—Robert A. Hafer
*Assistant Examiner*—C. Sam
*Attorney, Agent, or Firm*—Ernest Kettelson

[57] ABSTRACT

A pair of male shorts, particularly for small boys, having a protective cup supporter or pocket sewn in the undergarment itself. The shorts are the type which have three triangular spaced apart apertures which surround three different parts of the wearer's body and grip such parts of the body tightly enough for the three to enhance the ability of the undergarment to stay in place when the weight of a protective athletic cup is added to the undergarment. The three apertures of the undergarment are the elastic waistband and two elastic leg openings which grip the waist and both legs. A triangular pocket is sewn on the inside front of the pair of shorts, open along its upper edge to receive a conventional protective cup which is usually held in place by an athletic supporter or jock strap. Snaps or other fasteners are provided to close the pocket when the protective cup has been placed therein. An athletic supporter has only one body gripping aperture to hold it and a protective cup in place, namely its waistband, whereas the undergarment and protective cup supporter in accordance with this invention has three body gripping apertures to enhance its ability to hold the undergarment and protective cup in place. This is of particular importance for small boys whose waist and pelvis-hip region are so small that an athletic supporter or jock strap small enough to fit them does not have enough gripping power in the waistband along to hold it plus a relatively heavy protective cup from falling down.

12 Claims, 4 Drawing Sheets

MALE SHORTS HAVING PROTECTIVE CUP SUPPORTER

PRIOR APPLICATIONS

This application is a continuation of prior application Ser. No. 201,805 filed Jun. 3, 1988, now abandoned.

BACKGROUND OF THE INVENTION

This invention relates to the field of protective cups to protect the frontal pelvic region of men and boys while engaged in athletic activities and supporting devices to hold them in place.

Prior art supporting devices to hold such protective cups in place include athletic supporters or jock straps. These have an elastic waistband which provides only one body gripping aperture to hold the supporter and relatively heavier protective cup in place. For small boys in particular, whose waist and pelvic-hip region are very small, a single body gripping aperture is not enough to hold a supporting device plus protective cup in place. For others, including men who are extremely large around the waist, it is uncomfortable to have a single tight fitting body aperture around the waist. A supporting device which has more than one body gripping aperture does not have to fit as tightly around the waist in order to have the same ability to hold a protective cup in place. One which has three such body gripping apertures does not have to fit as tightly as one which only has two. The one in accordance with the present invention has three.

Examples of prior art devices to support protective cups for the pelvic region include those described in the following United States patents.

U.S. Pat. No. 4,453,541 discloses an athletic supporter having a waistband and a pair of leg straps attached at one end to the waistband and at their opposite ends to an elastic mesh protective enclosure positioned to protect the pelvic or groin region when worn. A pouch is stitched or sewn on the outside of the elastic mesh protective portion in which a protective cup can be inserted. The pouch has to be on the outside of the supporter as part of the inventive feature of this device, since the open upper edge of the pouch is held closed to keep the protective cup in place by the stretching which takes place when the supporter is put on. In other words, it doesn't need any fastening means by placing the pouch on the outside combined with the other structural features of that particular kind of prior art supporter.

U.S. Pat. No. 4,141,357 discloses a spherical pouch which is itself for the purpose of holding the male vital parts as stated in the abstract and particularly in claim 2 of that patent. The pouch is fastened to a garment by buckles, so it can be removed and used with different garments. The garments for which this removable pouch is designed are said to be one or more of the following: (1) an elastic band encircling the top edge, (2) a cord passing through a rolled over top seam encircling the top of the garment with the ends of the cord tied together, or (3) a belt encircling the top of the garment held in place with belt loops.

U.S. Pat. No. 4,128,902 discloses a pair of pants for gymnasts, and particularly for women gymnasts, having a pouch on the inside front for receiving two layers of foam of different density to protect the thigh, hip and pelvic area against injury while "wrapping" on uneven parallel bars. The pants in this case are shown and described as having an elastic waistband, but there is no disclosure of such for the leg apertures.

U.S. Pat. No. 4,014,044 discloses a protective device to protect the entire groin, pelvic and lumbar region of a male athlete for use particularly when engaging in the martial arts wherein blows to the pelvic-groin-lumbar region can come from below and from the back as well as from the front. The entire protective device of relatively rigid PVC material extends from the front, under and between the legs of the user, and up the back lumbar region of the user. A special pair of trunks are needed to use this protective device and hold it in place, made entirely of elastomeric material having specially constructed pockets in the front and back of the garment. The garment is open between the legs, the crotch portion being removed to provide an open relief to accomodate a full range of unrestrained leg motions. A special shield of fabric material is provided above the crotch and spanning the relief portion, which goes between the facing portion of the wearer's body and the protective bar extending between his legs.

U.S. Pat. No. 3,909,847 discloses a female pelvis and crotch protector in which pockets are provided in a cloth girdle or panty to receive protective pads for the front, crotch, rear and hip regions of the women's body. There is no indication that the weight of the spongy type pads are such that any more holding support is needed than that provided by the elastic waist band. In fact, the patent itself discloses that other means for holding the crotch pad in place are elastic or harness similar to those commonly used for supporting male crotch protectors or suspensories. Those of course are already known to the prior art as the patent indicates.

U.S. Pat. No. 3,782,375 discloses an athletic protector which utilizes a prior art type athletic supporter to which Velcro strips have been added on the outside front to grip corresponding Velcro strips added to the outer surface of a protective cup, to hold it in place that way on the outside front of the athletic supporter.

SUMMARY OF THE INVENTION

It is an object of the invention to provide a supporting garment for a protective cup to hold it in position to protect the frontal pelvic area of a male athlete in which additional body gripping apertures are provided in the garment to supplement the holding power of the elastic waistband.

It is an object of the invention to provide a supporting garment for a protective cup to hold it in position to protect the frontal pelvic area of a young boy, wherein the supporting garment has a plurality of body gripping apertures sufficient to hold the protective cup in place even though the boy's waist and hip region is too small for a conventional waist only body gripping type of supporting device to do so.

It is an object of the invention to provide a supporting garment for a protective cup to hold it in position to protect the frontal pelvic area of a male athlete, wherein the garment may be an ordinary pair of shorts of the type having elastic body gripping waist and leg apertures and in which a pocket to receive the protective cup can be sewn.

DESCRIPTION OF PREFERRED EMBODIMENT

Figure 1:
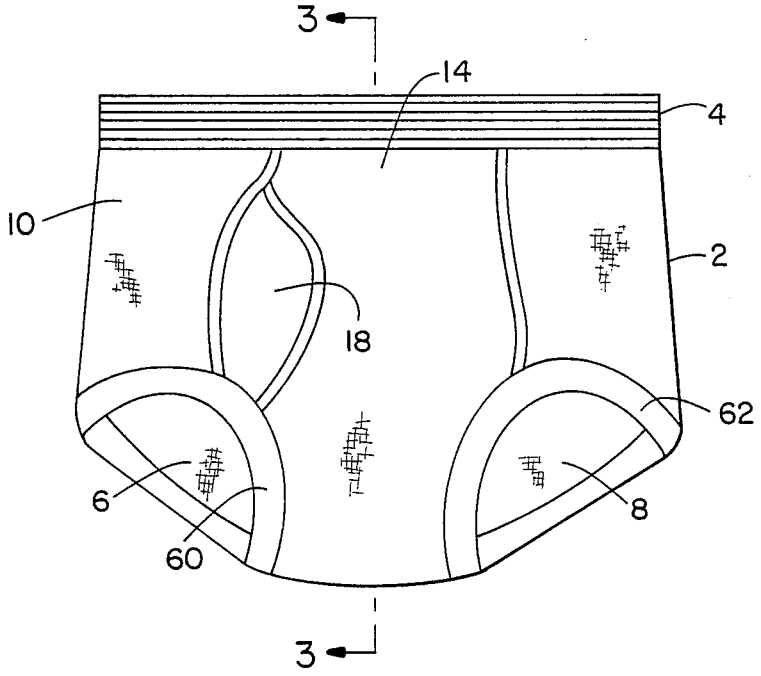
FIG. 1 is a front elevation view of a protective cup supporter garment in accordance with this invention.
Figure 2:
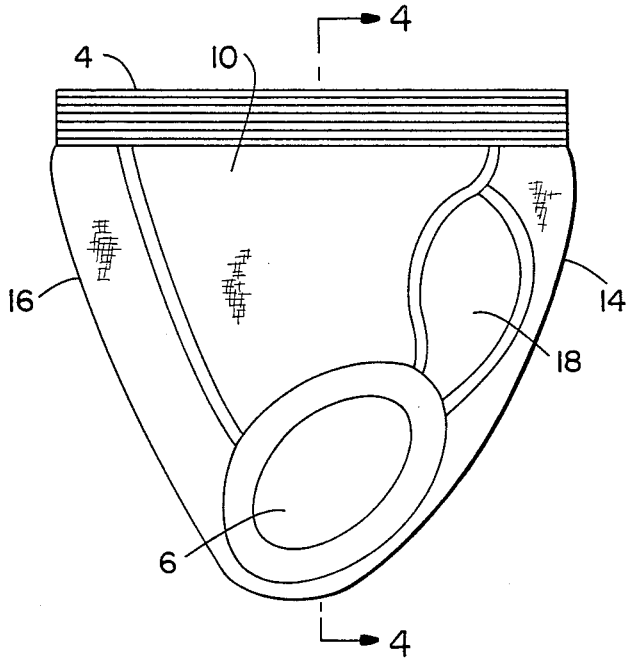
FIG. 2 is a side elevation view of a protective cup supporter garment in accordance with this invention.
Figure 3:
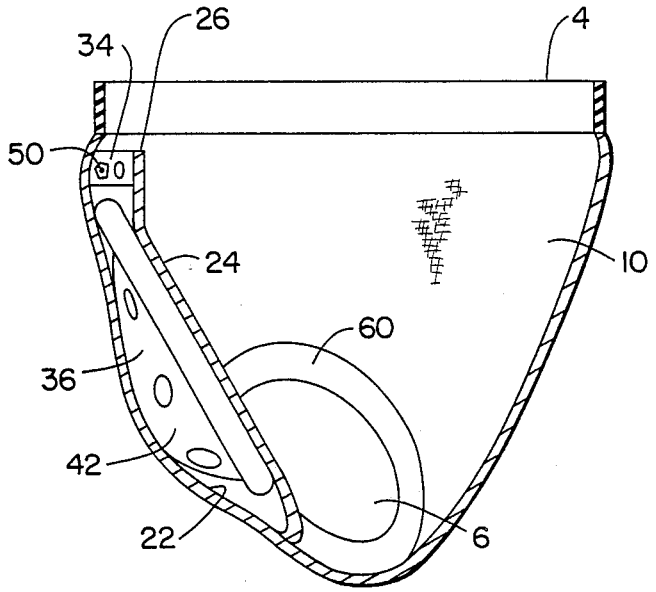
FIG. 3 is a section view taken on line 3—3 of FIG. 1, except that the protective cup supported therein is shown in side elevation.
Figure 4:
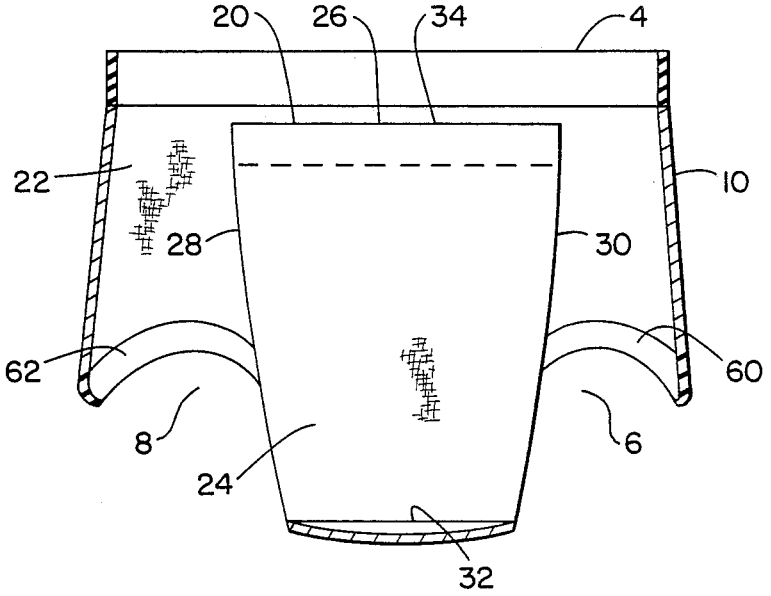
FIG. 4 is a section view taken on line 4—4 of FIG. 2.
Figure 5:
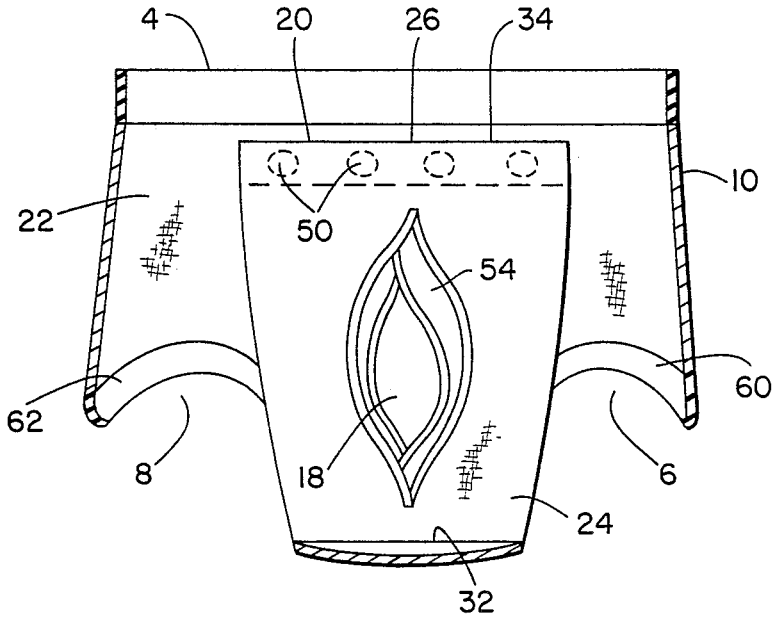
FIG. 5 is a section view similar to FIG. 4 but showing a modification in which a slot is provided in the wall of the protective cup pocket in registration with the fly aperture of the garment for a through passageway into the body cavity of the garment.
Figure 6:
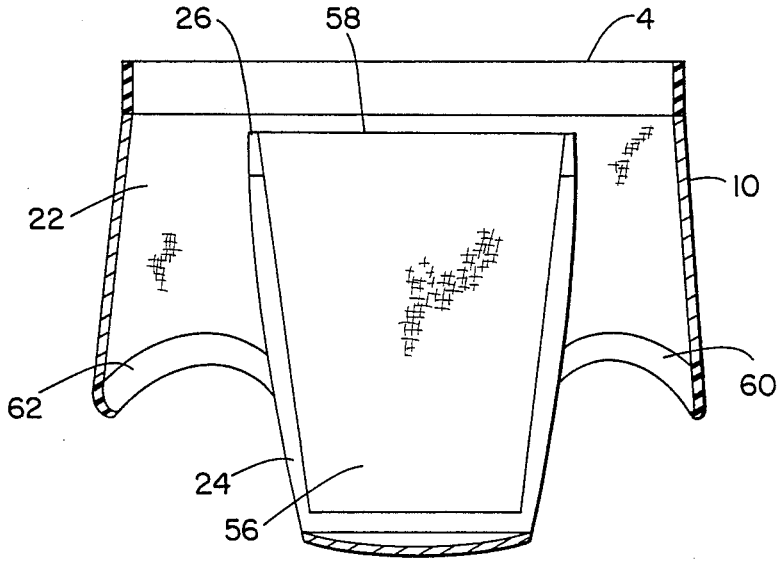
FIG. 6 is a section view similar to FIG. 5 but showing a movable flap covering the slot in the wall of the protective cup pocket.
Figure 7:
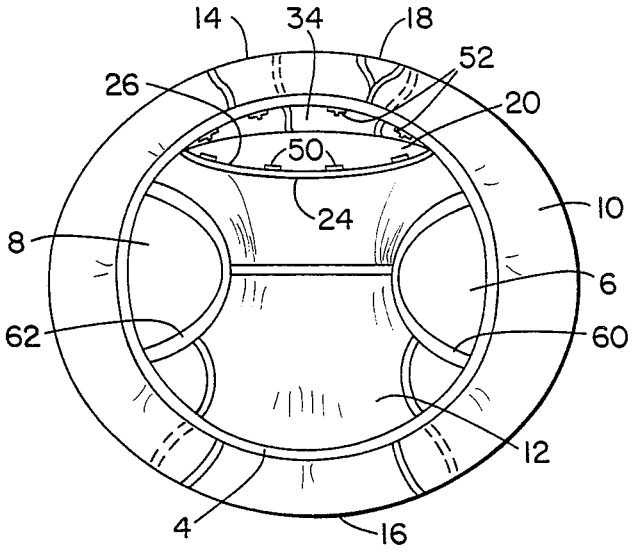
FIG. 7 is a top plan view of a protective cup supporter garment in accordance with this invention.
Figure 8:
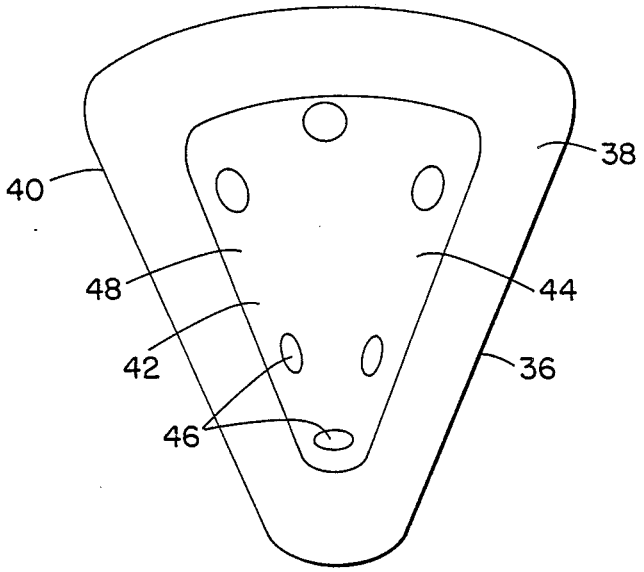
FIG. 8 is a rear elevation view of a protective cup for use with this invention.

A protective cup supporter in accordance with this invention includes an undergarment 2 which can be worn as an ordinary pair of mens or boy's shorts, having a body gripping elastic waist band 4 and a pair of body gripping elastic leg apertures 6 and 8. The undergarment 2 has a continuous peripheral wall 10 of flexible sheet fabric material such as cotton, or a blend of cotton, polyester and nylon, or similar fabric materials, extending downwardly from the elastic waistband 4 to form a pelvic, groin, lumbar cavity 12 opening to the elastic leg apertures 6 and 8.

The peripheral wall 10 of the undergarment 2 has a frontal portion 14 facing the wearer's pelvic region when worn and a rear portion 16 facing the wearer's lumbar and sacral-region when worn.

The peripheral dimension of the elastic waistband 4 in its contracted or unexpanded position is smaller than the corresponding peripheral dimension of the waist of the person for whom the undergarment is intended. It is expandable to conform to the dimension and configuration of the person's waist when worn, thereby providing a snug body gripping fit around the waist to support and hold the undergarment 2 in place.

The peripheral dimension of each elastic leg aperture 6 and 8 in its respective contracted or unexpanded position is also smaller than the corresponding peripheral dimension of that part of each leg of the person for whom the undergarment is intended which faces and contacts each respective elastic leg aperture when the undergarment 2 is being worn. The elastic leg apertures 6 and 8 are also expandable to conform to the dimension and configuration of the person's legs respectively at the portions thereof which face and contact each respective elastic leg aperture 6 and 8 when the undergarment 2 is being worn. The elastic leg apertures 6 and 8 thereby also provide a snug body gripping fit around each leg respectively to help support and hold the undergarment 2 in place.

The frontal portion 14 of the peripheral wall 10 of the undergarment 2 has the usual fly aperture 18 of male undergarments opening to the cavity 12.

The elastic waistband 4 is stretchable from its normally contracted position to an expandable position. In its normally contracted position, the waistband 4 has a smaller peripheral dimension than the adjacent peripheral dimension of the peripheral wall 10 bounding the cavity 12 of the undergarment 2.

A protective cup receiving pocket 20 is provided along the inwardly facing surface 22 of the frontal portion 14 of the peripheral wall 10. The cup receiving pocket 20 comprises a fabric panel 24 of general V-configuration, having a relatively wide upper edge 26 and side edges 28 and 30 which coverge as the extend downwardly to a relatively narrower bottom edge 32. The side edges 28 and 30 and bottom edge 32 are sewn to the frontal portion 14 of the peripheral wall 10. The upper edge 26 is not sewn to the peripheral wall 10 and there by provides an opening 34 through which to insert a protective cup 36. The bottom edge 22 of the fabric panel 24 extends between the leg apertures 6 and 8. The upper edge 26 of the fabric panel 24 extends substantially parallel to the waistband 4 and is spaced apart therefrom inwardly of the cavity 12 and along the upper frontal portion 14 of the peripheral wall 10.

The protective cup 36 is of generally V-shaped peripheral configuration, having a peripheral strip 38 of compressible, cushioning material such as rubber around the peripheral edge 40. The body of the cup 36 has a relatively rigid peripheral wall 42 which converges as it extends outwardly from the peripheral edge 40 to form a protective cavity 44. A plurality of cup apertures 46 are provided in the peripheral wall 42 for circulation of air in and through the protective cavity 44. The peripheral edge 40 surrounds the opening 48 to the protective cavity 44 of the cup 36.

The relatively wide upper edge 26 of the pocket forming fabric panel 24 is provided with spaced apart recess elements 50 of two-part snap fasteners. The facing portion of the inner surface 22 of peripheral wall 10 is provided with corresponding insert elements 52 of the snap fasteners spaced apart thereon in registration with respective ones of the recess elements 48. The opening 34 to the pocket 20 may therefor be closed after the protective cup 36 has been inserted therein. The cup 36 is placed in the pocket 20 with the opening 48 to its protective cavity 44 facing inwardly in the direction toward the fabric panel 24 of the pocket 20 and the pelvic, groin, lumbar cavity 12 of the undergarment 2.

After an athletic activity is over during which a protective cup 36 is placed in the pocket 20 of the undergarment 2, the protective cup 36 can be removed and the undergarment 2 worn as the regular pair of shorts for the remainder of the day if desired. For use without the protective cup 36, a slot 54 may be provided in the fabric panel 24 in registration with the fly aperture 18 in the peripheral wall 10 of the undergarment 2. A fabric flap 56 may if desired be provided to cover the slot 54, secured along one edge 58 to the fabric panel 24 and movable to provide access to the slot 54 and fly aperture 18.

The leg apertures 6 and 8 are bordered by continuous elastic bands 60 and 62 respectively.

The undergarment 2 in accordance with this invention is particularly useful for small boys whose waist and hip region are too small to hold prior art types of athletic supporters in place which have only an elastic waistband. Protective cups are relatively heavy particularly in relation to the size of a small boy and the size supporter he would need. The present invention makes it possible to sew a pocket 20 in a pair of small boy's regular jockey type shorts which have an elastic waistband 4 and elastic leg apertures 6 and 8 which in their contracted positions have a peripheral dimension smaller than the corresponding peripheral dimensions of the boy's waist and that part of his legs gripped by the leg apertures. When the shorts of this type are put on, the waistband and leg apertures expand to grip the corresponding portion of the boy's body at three spaced apart locations, thereby holding the shorts in place with sufficient strength to also support the weight of a protective cup 36 when inserted into the pocket 20 and keep it in place facing the pelvic region of the boy's body.

The fabric material of cotton, polyester, nylon and the like from which the peripheral wall 10 of the undergarment or shorts are made, is light weight and free fitting. It conforms readily to the body shape of the wearer where it touches and permits full and free movement of all parts of the wearer's body in contact therewith. The fabric material of the peripheral wall 10 does not restrict, limit, compress or restrain the portions of the wearer's body in contact therewith. The fabric material of peripheral wall 10 is also light weight and porous to lessen any tendency to build up body heat and to minimize sweating. In addition, the fabric material of peripheral wall 10 is absorbent and porous enough to absorb body moisture and to aid in dissipating body moisture such as sweat by allowing it to penetrate the fabric material, become exposed to the surrounding air and evaporate.

I claim:

1. A protective cup supporter and cup combination, comprising an item of wearing apparel having a flexible sheet peripheral wall bounding a pelvic cavity, said flexible sheet peripheral wall comprising a lightweight fabric material which is free fitting and incompressible of the portion of the wearer's body in contact therewith, said lightweight fabric material comprising cotton, said peripheral wall terminates at an upper edge thereof surrounding an opening to said pelvic cavity, an expandable and contractible waist band extending around said upper edge of said peripheral wall, said expandable and contractible waist band having a first peripheral dimension when in its said contracted position and a greater second peripheral dimension when in its said expanded position, said first peripheral dimension of said waistband being smaller than said upper edge of said flexible sheet peripheral wall, a pair of spaced apart expandable and contractible leg apertures opening to said pelvic cavity, said expandable and contractible leg apertures being expandable from a small peripheral dimension contracted position to a larger peripheral dimension expanded position, said peripheral wall having a frontal portion which faces the pelvic region of a person when said item of wearing apparel is being worn, and a protective cup pocket along said frontal portion of said peripheral wall to receive a protective cup therein and position it to face the pelvic region of a said person when said item of wearing apparel is being worn, including a protective cup in said pocket, said protective cup having a relatively rigid peripheral wall bounding a protective cup cavity opening in the direction toward said pelvic cavity of said item of wearing apparel, said protective cup cavity when in place in said pocket having an upper edge adjacent the upper pelvic region of said person when said item of wearing apparel is being worn, said cavity and rigid peripheral wall diverging outwardly as they extend downwardly thereby spacing the lower portion of said rigid peripheral wall away from the lower pelvic region of said person to provide a spaced apart rigid wall protective barrier for said lower pelvic region of said person.

2. A protective cup supporter as set forth in claim 1, wherein said expandable and contractible waist band includes a continuous strip of elastic material stretchable between said contracted position and said expanded position of said waist band.

3. A protective cup supporter as set forth in claim 1, wherein said pair of expandable and contractible leg apertures each include a continuous strip of elastic material stretchable between said contracted position and said expanded position of said leg apertures.

4. A protective cup supporter as set forth in claim 1, wherein said expandable and contractible waist band and leg apertures each include a continuous strip of elastic material stretchable between said respective contracted and expanded positions thereof.

5. A protective cup supporter as set forth in claim 1, wherein said frontal portion of said peripheral wall of said item of wearing apparel includes a fly aperture opening to said protective cup pocket, said protective cup pocket includes a corresponding aperture in registration with said fly aperture for a through passage to said pelvic cavity until a protective cup is placed in said protective cup pocket.

6. A protective cup supporter as set forth in claim 1, wherein said protective cup pocket includes a fabric panel having an upper edge, spaced apart side edges and a bottom edge, said side edges and said bottom edge being secured to said frontal portion of said peripheral wall of said item of wearing apparel, said upper edge being separable from said peripheral wall to provide an entrance into said pocket for a said protective cup, including fastening means to close said entrance to said pocket.

7. A protective cup supporter as set forth in claim 6, wherein said protective cup pocket is on the inwardly facing side of said frontal portion of said peripheral wall of said item of wearing apparel.

8. A protective cup supporter as set forth in claim 1, wherein said waist band when in its said contracted position has a peripheral dimension smaller than the corresponding peripheral dimension of the waist of a said person for whom said item of wearing apparel is intended whereby said expandable and contractible waist band is a body gripping aperture, said pair of leg apertures when in their said contracted position have a peripheral dimension smaller than the corresponding peripheral dimension of the respective legs of a said person for whom said item of wearing apparel is intended at the portions thereof facing and in contact with said leg apertures respectively when being worn, whereby said pair of expandable and contractible leg apertures are also body gripping apertures.

9. A protective cup supporter, comprising an item of wearing apparel having a flexible sheet peripheral wall comprising cotton material bounding a pelvic cavity, said pelvic cavity being incompressible of the portion of a wearer's body received therein, a body gripping waist aperture opening to said cavity, a first gripping leg aperture opening to said cavity and a second body gripping leg aperture opening to said cavity, said body gripping apertures each having smaller peripheral dimensions when said item of wearing apparel is not being worn than the respective immediately adjacent portions of said cavity bounded by said flexible sheet peripheral wall, said peripheral wall having a frontal portion which faces the pelvic region of a person when said item of wearing apparel is being worn, and a protective cup pocket along said frontal portion of said peripheral wall to receive a protective cup therein and position it to face the pelvic region of a said person when said item of wearing apparel is being worn, including a fly aperture in said frontal portion of said peripheral wall of said item of wearing apparel, said protective cup pocket includes a pair of side edges sewn to said said frontal portion of said peripheral wall to provide a pair of closed side walls of said pocket, and a corresponding aperture in said protective cup pocket spaced apart from said side edges thereof to provide a through passageway to said pelvic cavity until a protective cup supporter is placed in said protective cup pocket.

10. A protective cup supporter as set forth in claim 9, including a fly aperture in said frontal portion of said peripheral wall of said item of wearing apparel, and a corresponding aperture in said protective cup pocket to provide a through passageway to said pelvic cavity until a protective cup is placed in said protective cup pocket.

11. A protective cup supporter as set forth in claim 1, wherein said light weight, free fitting flexible sheet peripheral wall of said item of wearing apparel comprising cotton material is porous and absorbent to absorb body moisture, and to allow such moisture to penetrate such flexible sheet peripheral wall for exposure to surrounding air and for evaporation thereof.

12. A protective cup supporter as set forth in claim 9, wherein said flexible sheet peripheral wall of said item of wearing material comprising said incompressible pelvic cavity is light weight, free fitting, porous and absorbent cotton material to absorb body moisture, and to allow such moisture to penetrate such flexible sheet peripheral wall for exposure to surrounding air and for evaporation thereof.

* * * * *